US010378754B1

(12) United States Patent
Durrence et al.

(10) Patent No.: US 10,378,754 B1
(45) Date of Patent: Aug. 13, 2019

(54) SYSTEMS AND METHODS FOR REFILLING LIQUID FUEL CANDLES

(71) Applicants: Jamie Durrence, Savannah, GA (US); Robert Perkins, Savannah, GA (US); Leslie Ciechanowski, Savannah, GA (US); Brad Ciechanowski, Savannah, GA (US)

(72) Inventors: Jamie Durrence, Savannah, GA (US); Robert Perkins, Savannah, GA (US); Leslie Ciechanowski, Savannah, GA (US); Brad Ciechanowski, Savannah, GA (US)

( * ) Notice: Subject to any disclaimer, the term of this patent is extended or adjusted under 35 U.S.C. 154(b) by 0 days.

(21) Appl. No.: 16/242,573

(22) Filed: Jan. 8, 2019

Related U.S. Application Data

(60) Provisional application No. 62/657,446, filed on Apr. 13, 2018.

(51) Int. Cl.
*B67C 3/02* (2006.01)
*F21V 37/00* (2006.01)
*C11C 5/00* (2006.01)

(52) U.S. Cl.
CPC ..... *F21V 37/0012* (2013.01); *C11C 5/006* (2013.01)

(58) Field of Classification Search
CPC ..... F21V 37/0012; C11C 5/006; F23D 3/16; F23D 3/22
See application file for complete search history.

(56) References Cited

U.S. PATENT DOCUMENTS 3,158,015 A * 11/1964 Renwick, Sr. ..... F23D 3/16 431/125
3,169,387 A * 2/1965 Cordillo ..... F23D 3/16 431/125
4,281,692 A * 8/1981 Caccamisi ..... F21V 37/0012 141/370
6,010,333 A * 1/2000 Tendick, Sr. ..... F23D 3/18 431/324
7,063,526 B2 * 6/2006 Ham ..... F21S 13/00 431/253
7,731,492 B2 * 6/2010 Kubicek ..... F23D 3/16 431/288
8,763,655 B2 7/2014 Springer
8,777,182 B2 7/2014 Springer
9,400,103 B1 7/2016 Cap
RE46,173 E * 10/2016 Jorge ..... F21V 37/0012
(Continued)

*Primary Examiner* — Reinaldo Sanchez-Medina
(74) *Attorney, Agent, or Firm* — John G. Posa; Belzer PC

(57) ABSTRACT

A system and method for refilling a liquid fuel candle includes a refillable container and a refilling station with a reservoir of liquid fuel and a designated region for receiving the refillable container. A user control activates a pump causing fuel to flow from the reservoir and into the container until a predetermined fill level is reached, at which time the pump is deactivated. In one configuration the bottom of the container includes a port that cooperates with a post on the refilling station causing the candle to fill from the bottom up. The refilling station may further include an input for receiving a colorant or a scent that is added to the fuel as it flows from the reservoir to the container. The refilling station may include a plurality of designated regions for receiving a plurality of containers to be refilled, including simultaneous refilling.

30 Claims, 11 Drawing Sheets

(56) References Cited

U.S. PATENT DOCUMENTS

| | | | | |
|---|---|---|---|---|
| 2001/0038987 | A1* | 11/2001 | Jun | F23D 3/16<br>431/126 |
| 2002/0119413 | A1* | 8/2002 | Cheng | A63J 17/00<br>431/289 |
| 2007/0072140 | A1* | 3/2007 | Almodovar | F23D 3/16<br>431/289 |

* cited by examiner

SYSTEMS AND METHODS FOR REFILLING LIQUID FUEL CANDLES

REFERENCE TO RELATED APPLICATIONS

This invention application claims priority to, and the benefit of, U.S. Provisional Patent Application Ser. No. 62/657,444, filed Apr. 13, 2018, the entire content of which is incorporated herein by reference.

FIELD OF THE INVENTION

This invention relates generally to candles such as tea lights that burn liquid fuel and, in particular, to systems, devices and methods for refilling these and other sources of light and heat.

BACKGROUND OF THE INVENTION

In many environments, both private and public, candles are used to create a sense of ambience or calm. Today there are many options, including actual wax candles, electronic candles, and liquid fuel candles. Each option has drawbacks. Wax candles are relatively expensive, and they can go out, drip or sag. Electronic candles need battery replacement and they are inferior to an actual flame. Liquid fuel candles are more manageable but they are also expensive over time and generate considerable environmental waste. There is an outstanding need, therefore, for an effective, cost-effective alternative.

SUMMARY OF THE INVENTION

This invention resides in a system for refilling a liquid fuel candle, which includes an inventive refillable candle and a refilling station adapted to receive and refill the candle. Other aspects of the invention are independently directed to the refilling station, the candle, and to methods of refilling a liquid fuel candle.

In accordance with a system aspect, the candle includes a refillable container having an interior defined by a top, a bottom, and a sidewall. A wick extends from the interior of the container and protrudes through the top of the container. A refilling station includes a reservoir for a supply of liquid fuel and a designated region for receiving the container. A fuel line extends from the reservoir to the container when the container is received by the refilling station. A user interface disposed on the refilling station includes a user control operative to activate a pump in the refilling station, causing fuel to flow from the reservoir and into the container until a predetermined fill level is reached, at which time the pump is manually or automatically deactivated.

In the preferred embodiment, the bottom of the container includes a port into which the fuel flows from the fuel line, such that the candle fills from the bottom up. The refilling station may further include an input for receiving a colorant or a scent that is added to the fuel as it flows from the reservoir to the container. As a further option, the refilling station may include a plurality of designated regions for receiving a plurality of containers to be refilled, including simultaneous refilling.

The apparatus for sensing when the fuel delivered to the container has reached a predetermined fill level may include a float switch in the container and electrical contacts between the container and the refilling station causing the pump to deactivate when the predetermined fill level reaches the float switch. Alternatively, the apparatus for sensing when the fuel delivered to the container has reached a predetermined fill level includes light source and detector in the refilling station operative to sense when the predetermined fill level has been reached. As yet a further alternative, the sensing apparatus may include a sensor for sensing the pressure required to deliver the liquid fuel to the container, such that the pump is deactivated when the pressure reaches a predetermined level.

The refilling station may include a user interface with a plurality refill controls and indicator lights, at least including lights that indicate that the candle is properly seated in the refilling station and that the candle is being refilled. The refilling station may be battery operated. The liquid fuel may be a liquefied wax or a plant or vegetable oil. The container may be made of transparent or translucent glass or plastic. Alternatively, the container may be constructed of metal with fuel selected to provide heat for chafing purposes, in which case a removable cap may be provided to fit over the wick when not in use.

DETAILED DESCRIPTION OF THE PREFERRED EMBODIMENTS

Figure 1:
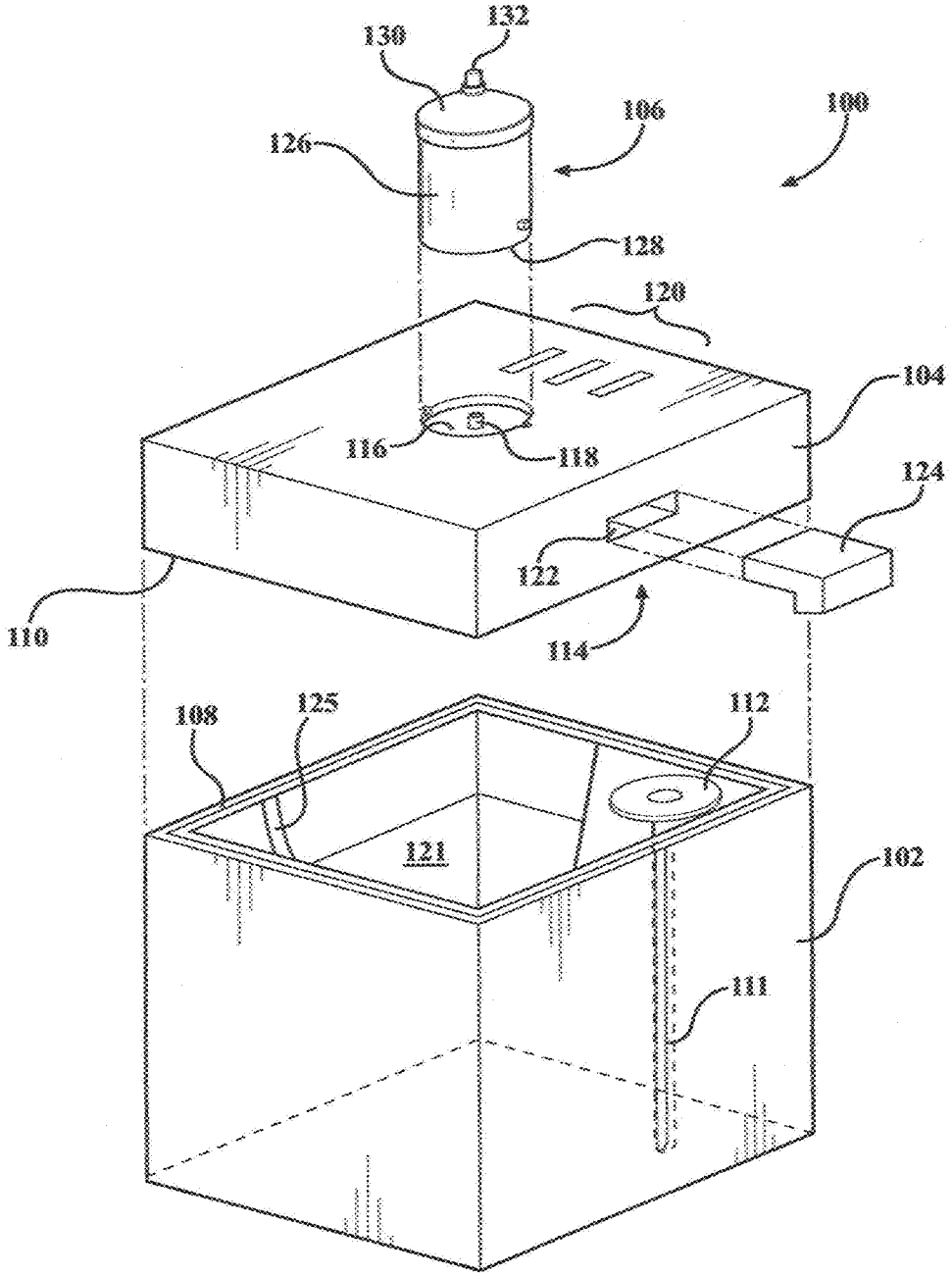
FIG. 1 is an exploded view of a preferred embodiment of the invention.

FIG. 1 is an exploded view of a preferred embodiment of the invention, depicted generally at 100, noting that the elements shown in this, and the other drawings herein, are not necessarily to scale. The system includes a reservoir 102 used to contain liquid fuel 121, and a housing 104 that fits onto the reservoir and holds fuel transfer components, user interfaces, and electronics.

The housing 104 receives a liquid-fuel candle 106 that includes a container 126 with a bottom surface 128 and a cap 130 through which a wick 132 protrudes. The bottom portion of the wick is immersed in the liquid fuel, which may be any combustible liquid, such as liquid paraffin or beeswax, though palm kernel oil is preferably used as being more environmentally friendly. The "candle" 106 may be any shape or size, and may be made of plastics, glass, metals, ceramics, or combinations thereof.

In the embodiment shown in FIG. 1, the candle is filled from the bottom up. The container 126 may be received in a station 116 including a fill port 118 described in further detail below. The container connection may include a bayonet-type fitting, as shown, or other types connections may be used, variations of which are also disclosed herein.

The housing 104 mates with the reservoir 102 through an interface formed by the bottom edge 110 of the housing 104 and the top edge 108 of the reservoir 102, forming a liquid-tight fit. The reservoir 102 includes a dip tube 111 including an upper coupling 112 that mates with an opposing coupling 114 on the housing, not visible in FIG. 1. The housing 104 preferably includes one or more indicators such as LEDs 120 that show status conditions.

The reservoir 102 may come in different shapes and sizes, including different ounce sizes, half-gallon, gallon, multiple gallons, and so forth. The reservoir (and candle) are proprietary, and devices may be included to ensure that only the proprietary reservoir and/or candle are used. For example, station 116 and/or coupling 112, 114 may include proprietary mechanical interlocks, optical, RFID or magnetic readers preventing system functioning if the proprietary reservoir and/or candle are not used (or used more that the fuel originally provided for in the proprietary reservoir).

Optionally, the housing may include a port 122 to receive a module 124 containing a scent and/or colorant that combines with the fuel in reservoir 102 as candle 106 is refilled. The ratio of the scent and/or colorant to the liquid fuel may be fixed, or may be adjustable through user controls on housing 104. The reservoir 102 may optionally include an integral handle 125.

Figure 2:
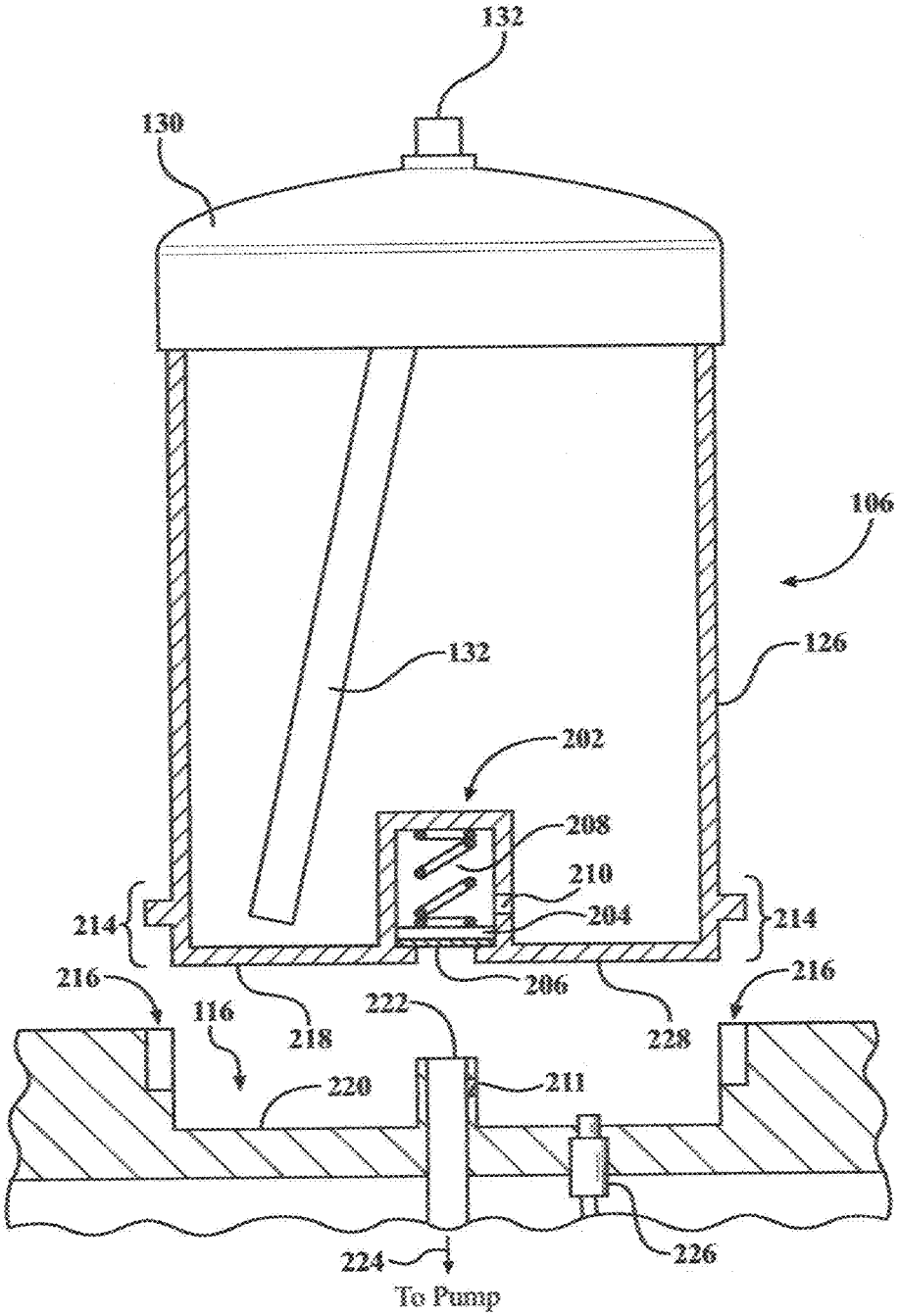
FIG. 2 is a drawing in partial cross section showing a bottom-up filling mechanism prior to container loading.

FIG. 2 is a detail drawing that illustrates a bottom-fill arrangement. In this case the station 116 includes an upwardly protruding tube 222 having a side port 211. The tube 222 is in fluid communication 224 with a pump coupled to the liquid in the reservoir 102. The refillable candle 106 includes a bottom surface 218 with a lower opening blocked off by a plunger 204 and compressible seal 206 urged against the lower opening by spring 208, thereby closing it off. The bottom opening also includes a side port 210. Although not shown, other seals such as O-rings may be provided as desired to reduce leakage.

Figure 3:
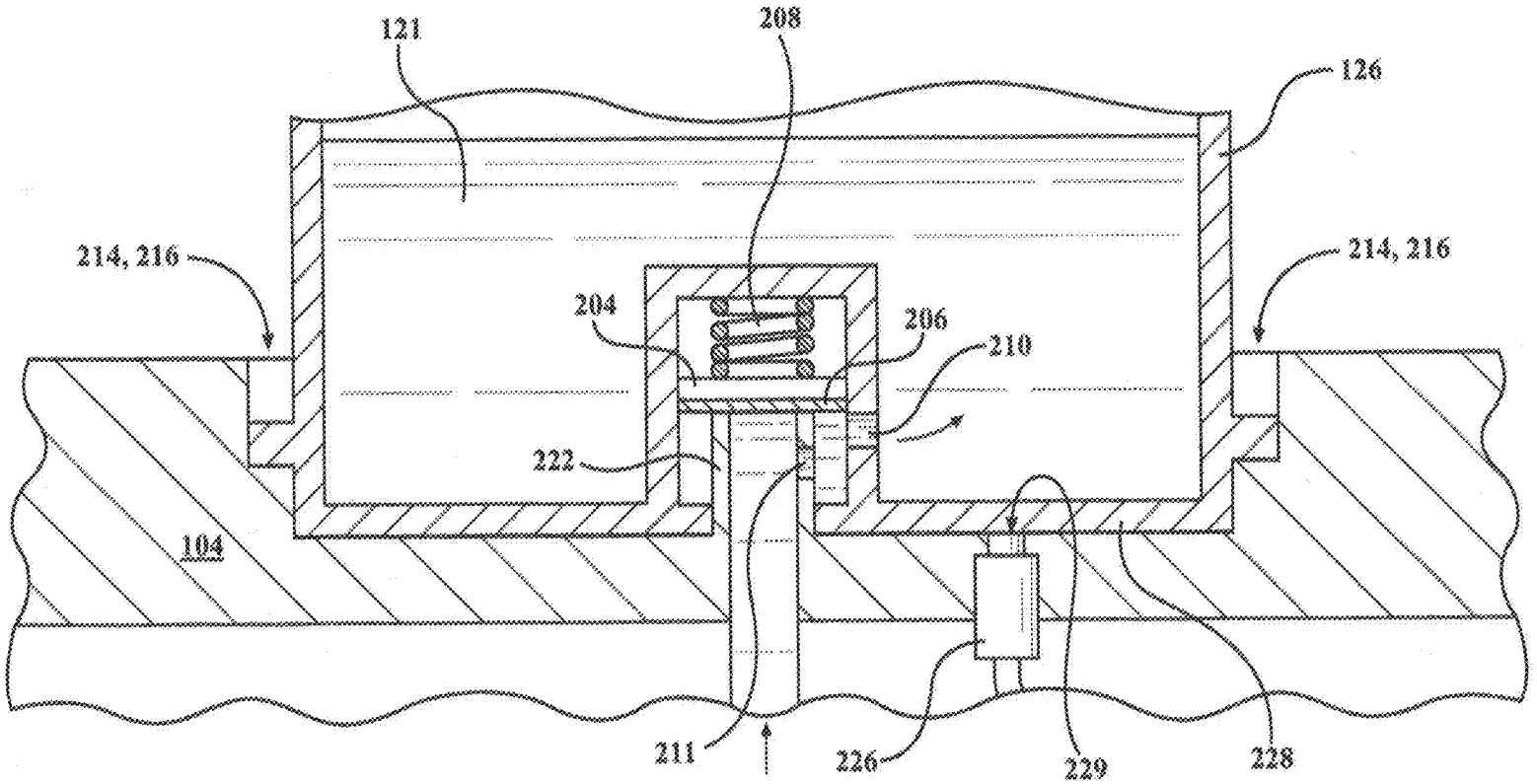
FIG. 3 is a detail drawing illustrating bottom-up container filling.

To refill the candle 106, the container 126 is mounted onto the station 116 such that tube 222 pushes against the spring-loaded seal as shown in FIG. 3. The candle container may simply be manually held in position during the refill operation, or an optional screw- or bayonet-type interlock 214, 216 may be provided such that with a twist the container 212 stays in position while allowing for easy removal. As opposed to the side of the container 126, the interlock may alternatively be provided between the bottom surface 218 of the container 126 and the upper surface 220 of the station 116.

A momentary or maintained contact switch 226 may be provided that is activated when bottom surface 228 presses down against the switch to let the system know that the refill process may commence. As opposed to a mechanical switch, an electrical, optical or magnetic detector may be used, in which case area 228 would be sensed electrically, optically or magnetically.

FIG. 3 is a detail drawing showing the candle container mounted on the housing 104, and with liquid fuel 121 flowing into the container. Note that tube 222 has pushed seal 206 and plunger 204 against spring 208, thereby allowing liquid to flow through ports 211, 210. The container is held in position with optional interlock 214, 216. Switch or sensor 226 is able to detect a corresponding identifying element 228 disposed on the bottom surface of the candle container 126. Alternately, a switch can be radially contacted by the bayonet signaling candle is down and radially locked before filling commences.

Various mechanisms may be used to ensure that the container is filled properly without being overfilled. As one example, a liquid-level or optical sensor may be used to determine the height of the liquid in the container, terminating flow if a maximum liquid level is reached. As another example, a flow meter may be used to monitor the amount of liquid flowing to the container, shutting off the flow when a maximum is reached. Alternatively, pressure build-up may be used to sense filling, as described in further detail below. In the preferred embodiment, the user may remove the container 126 at any time, in which case the sensor 226 will detect the detachment and immediately interrupt the flow of the liquid fuel.

Figure 4:
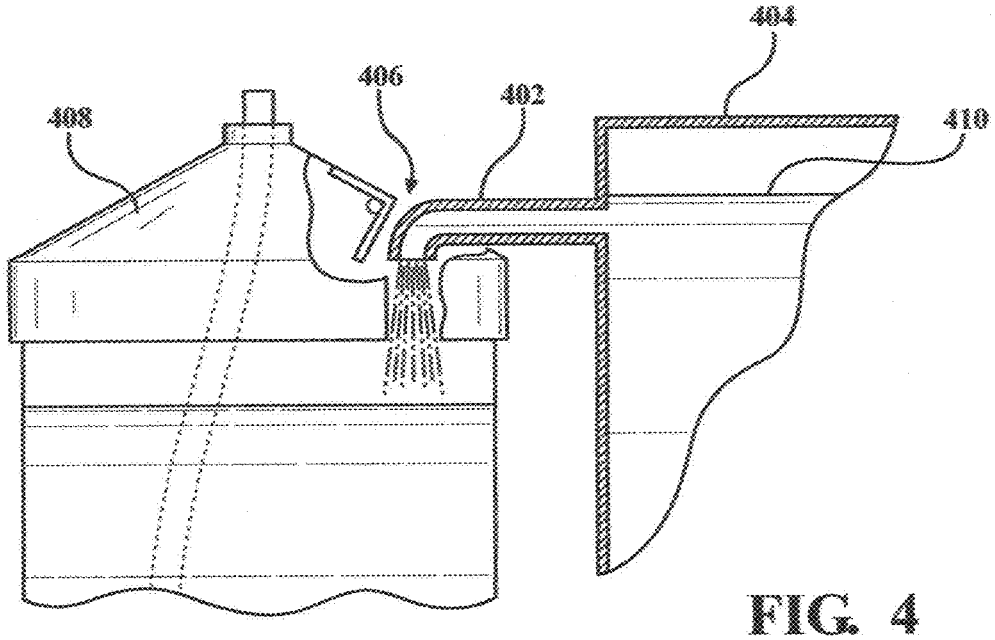
FIG. 4 is a top-down filling arrangement.

The bottom-up fill arrangement of FIGS. 2, 3 is not the only filling mechanism that may be used with the invention. Other types of fluid introduction devices may be used, including top filling and side filling. The goal in each case is to have minimal leakage during the refill process, ideally no leakage whatsoever. FIG. 4 illustrates one possible top-filling arrangement, wherein an arm 402 carries fuel from a chamber 404. As shown, the arm protrudes through a port in the cap 408 of the candle, which may in the form of a hinged door that closes off and seals the opening 406 when the arm is removed. The arm may be rigid, in which case the container may be moved into a filling position, or the arm may be articulated, and brought into the port from above or through the side. One advantage of the top-filling scheme shown in FIG. 4 is that as fluid is pumped into the chamber 404, the maximum fill level in the container cannot exceed the maximum fill level 410 in the chamber 404.

Figure 5:
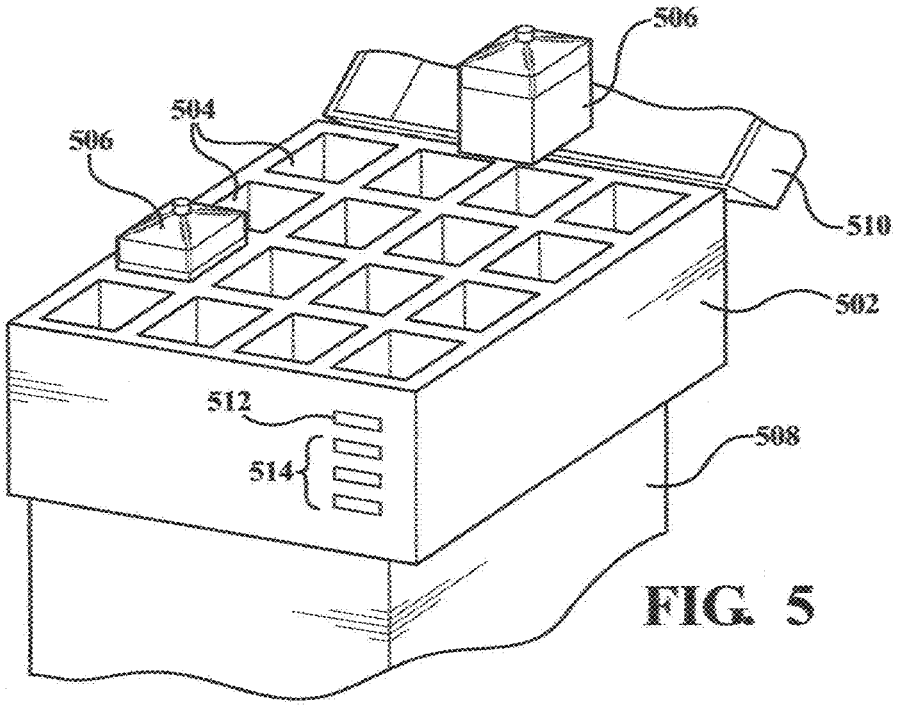
FIG. 5 is a drawing that shows multiple refill stations.

Nor is the invention limited to one-at-a-time container candle filling. As shown in the embodiment of FIG. 5, the housing 502 may include multiple stations 504, enabling multiple containers 506 to be simply dropped into position for automatic, simultaneously refilling. Either bottom-up, top-down (or side) fluid injection mechanisms may be used. Sensors may be used to determine if a particular station is occupied, so that fluid only flows to stations loaded with containers. A lid 510 may also be provided such that refueling can only occur when the lid is closed. The front of housing 502 may include a start button 512 as well as status indicators 514. While 16 stations are shown in the figure, more or fewer may be provided, such as 4 for home use, more than 16 for commercial use, and so on. Also, while square containers are shown for better packing round or other shapes may alternatively be used in this and in all embodiments.

Figure 6:
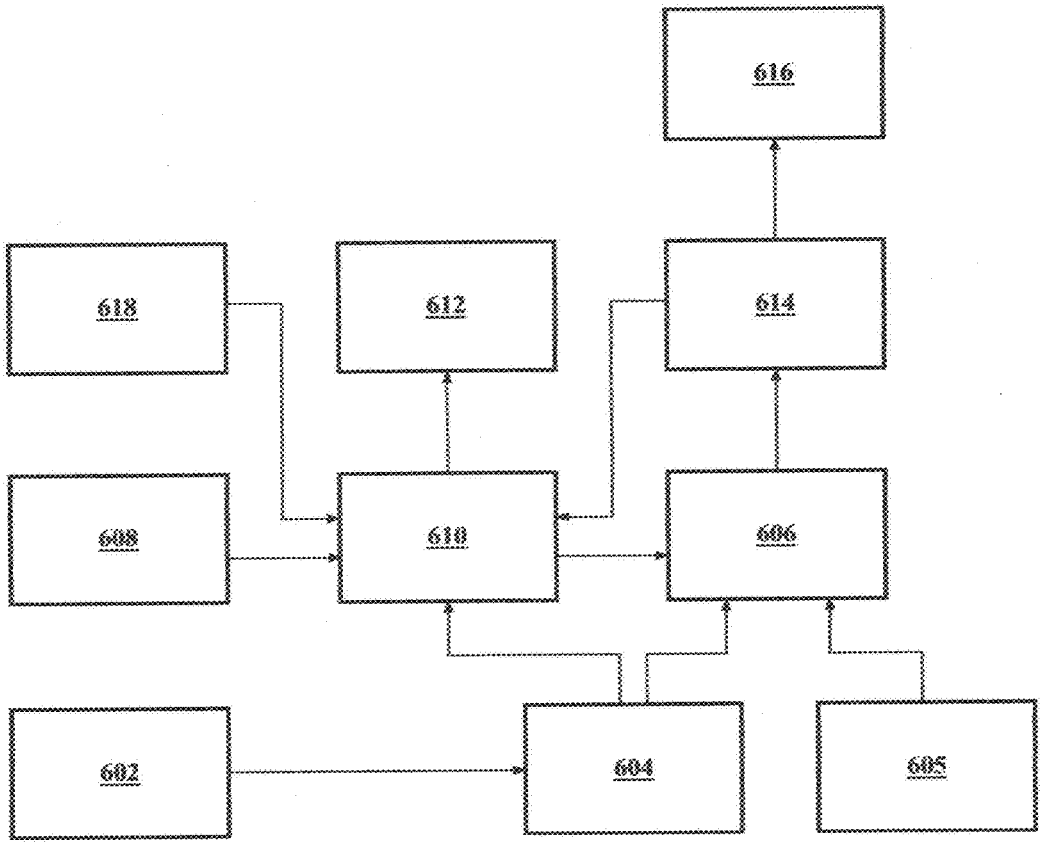
FIG. 6 is a block diagram showing major electrical and other components.

FIG. 6 is a simplified block diagram depicting electrical and other components. A power supply receives power from a line cord or USB connection 602, recharging battery supply 604. Battery 604 powers the electronic components including microcontroller 610 responsible for functional operations. Processor 610 receives signals from sensor(s) 608 operative to detect container installation, filling, etc. The processor 610 also drives pump 606 and LED indicators 612 in response to software programming of processor 610. Pump 606 draws fuel from reservoir 605 to container 616 through flow controller 614, which communicates status to controller 610.

The LED indicators may include an LED that illuminates when fueling begins and goes out when fueling is complete. A separate LED may be used to indicate battery charging, and may flash when the battery level falls below a predetermined level, and remain lit when a desired level of charging has been achieved. One or more LEDs may also be provided to indicate the status of the scent/colorant infuser, shown at 618.

Figure 7A:
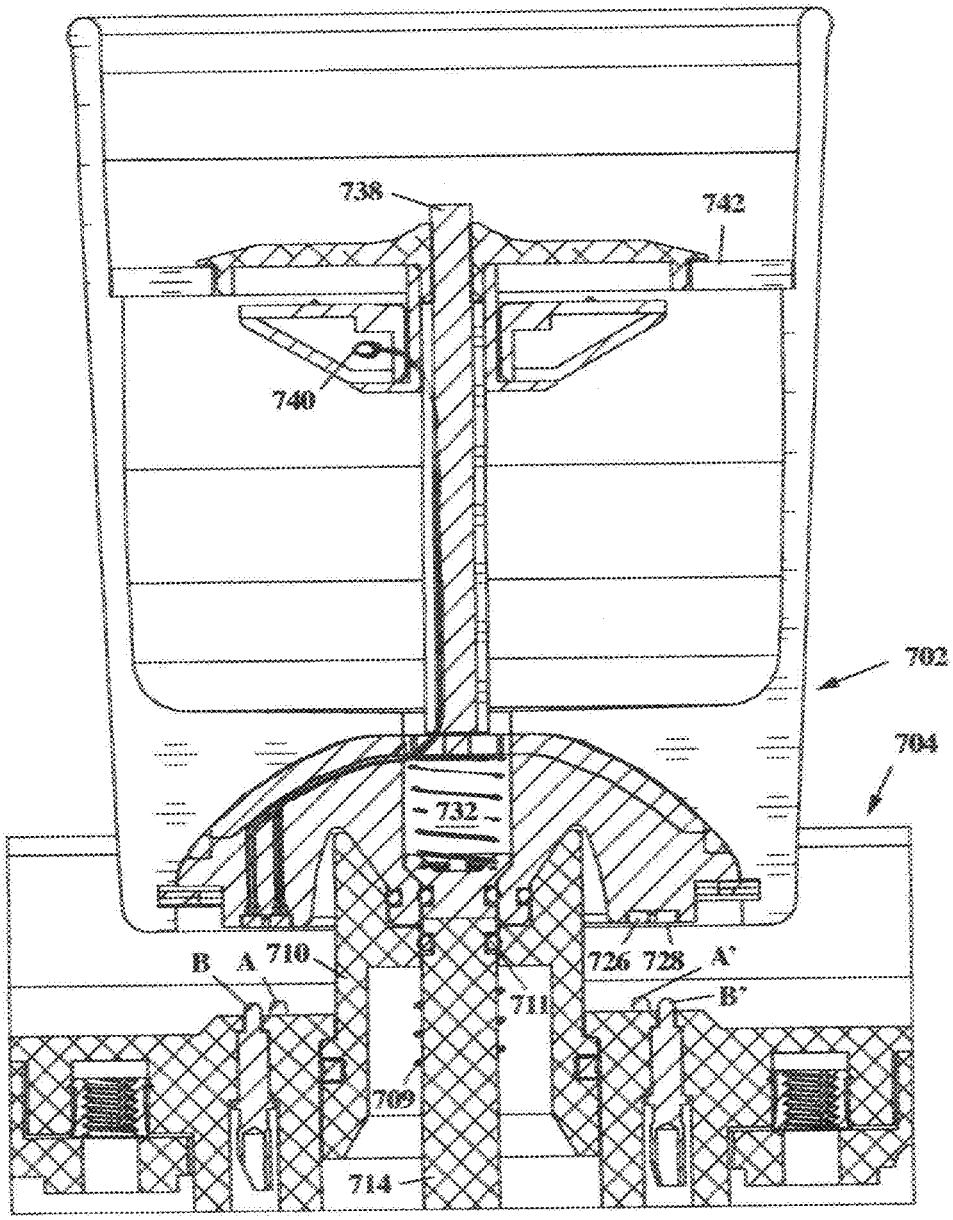
FIG. 7A illustrates a bottom-fill arrangement utilizing alternative sensor configurations and O-rings seals for enhanced leak prevention.
Figure 7B:
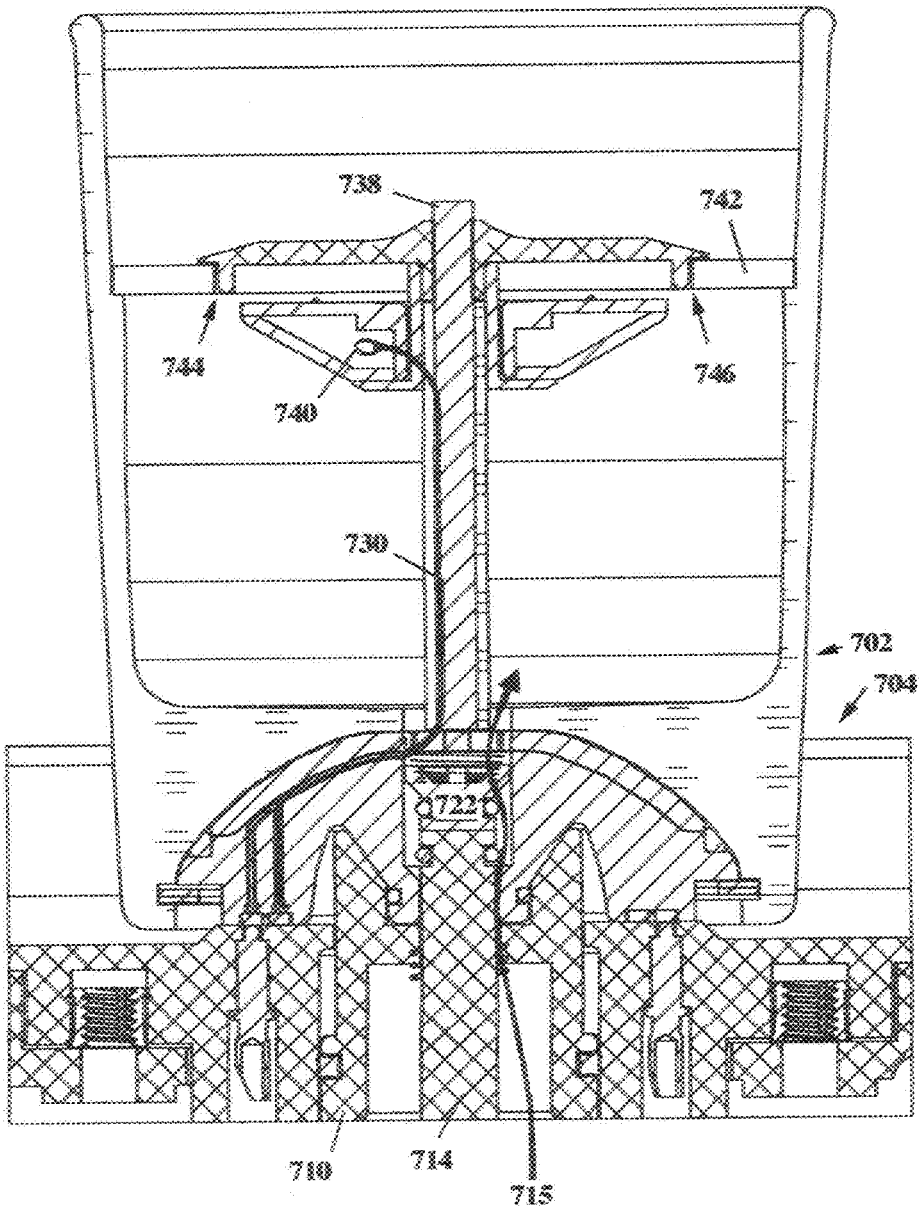
FIG. 7B shows the configuration of FIG. 7A with the candle inserted.
Figure 7C:
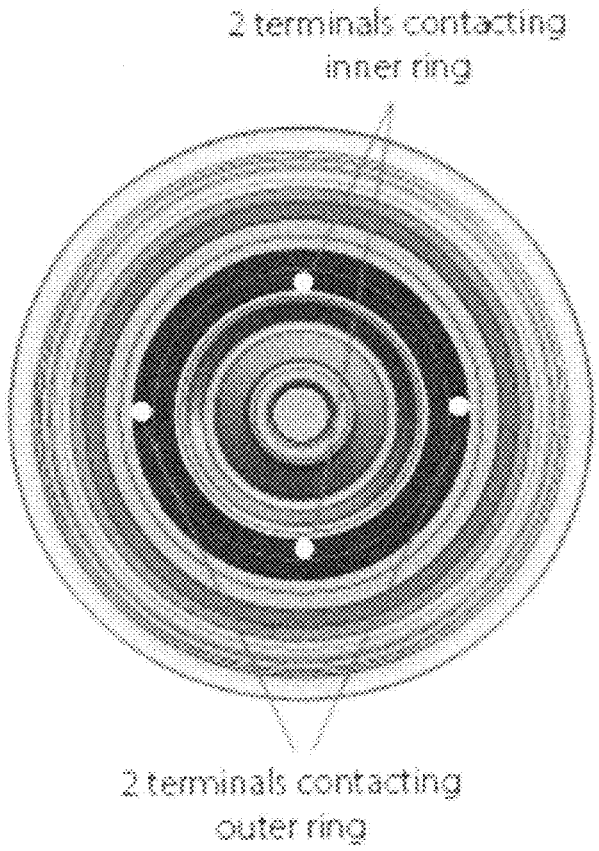
FIG. 7C shows the bottom of a candle container showing electrical conductors in the form of concentric rings.

FIG. 7A, B illustrate a bottom-fill arrangement utilizing alternative sensor configurations and O-rings seals for enhanced leak prevention. FIG. 7A shows the candle 702 just prior to full seating into refill station 704, and FIG. 7B shows the candle fully seated. The candle 702 has a bottom 706 that is received by a corresponding well 708 in refill station 704. As shown in FIG. 7C, the bottom surface of the candle 702 includes two concentric, metallic rings 726, 728 adapted to interact with two pairs of contacts A, B and A', B'. Inner ring 728 is used for candle detection, such that when the candle is inserted as shown in FIG. 7B, contacts A, A' (and B, B') are shorted, indicating that a candle is present.

When the candle is detected as properly seated, tube 714 pushes upwardly against component 722, compressing spring 732, as shown in FIG. 7B. Component 710 seats within recess 712 on the bottom of the candle, and is pushed downwardly while seating, with the various O-rings depicted in the drawings acting to minimize or prevent leakage during the candle installation and removal processes. Once properly seated, liquid fuel, under pressure from a fuel pump (not shown in FIG. 7A, B), causes fuel to flow up the path 715 shown, and out aperture 734.

As the fluid rises in the candle container, displaced air may pass through small ports 744, 746 in cap 742 through which wick 738 extends. Cap 742 may be of any suitable material, including metal. Wires 730 connect inner and outer rings 726, 728 to a float switch such as a magnetic reed switch 740. As shown, the wires may be dressed through the same channel as wick 738. When fluid reaches the float switch, the circuit closes between inner and outer rings 726, 728. That is, in this embodiment, fluid fill is detected as a short between contacts A, B (or A', B').

One purpose of component 710 is to ensure that, even with the candle removed, fuel is not pumped through path 715 in the event of a pump or sensor malfunction. In particular, as best seen in FIG. 7A, a spring 709 urges component 710 upwardly when no candle is present. In this configuration, the central port of component 710 is sealed with O-ring 711, preventing flow. When component 710 is pushed downwardly, however, path 715 is open, allowing fuel to flow upwardly and into candle container 702.

Figure 8:
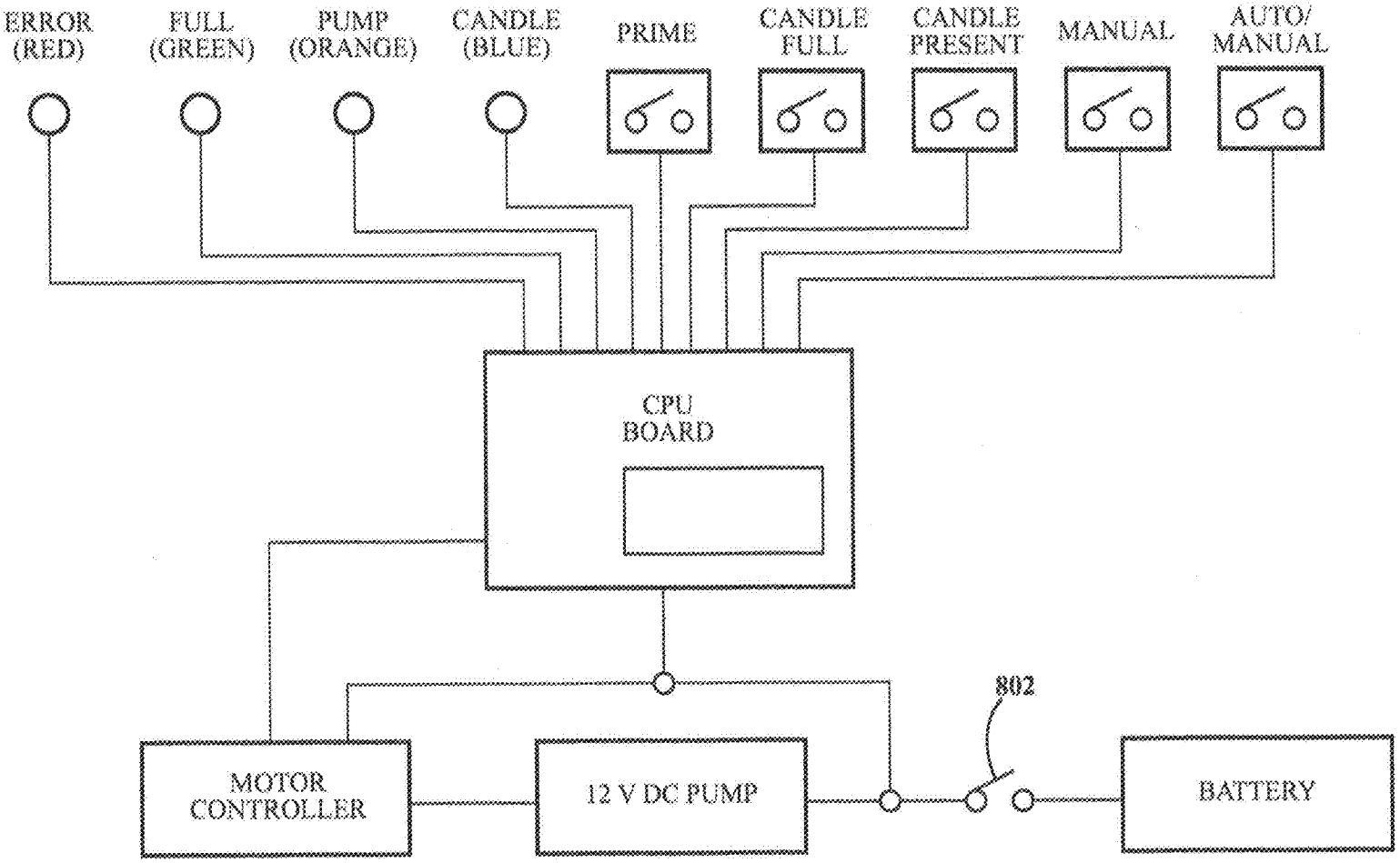
FIG. 8 is a block diagram that illustrates available functions and rechargeable battery operation.

FIG. 8 is a block diagram that better illustrates available functions and rechargeable battery operation. The battery (or other power source) connects to the pump, motor controller and CPU board through ON/OFF switch 802. The CPU may be based upon any suitable microprocessor or microcontroller known to those of skill in the art. The CPU board interfaces to various switches and status indicators. The CANDLE PRESENT and CANDLE FULL switches have already been described. Other switches may be provided for priming fuel, from a new container, for example, as well as AUTO/MANUAL and fully MANUAL operation.

The (LED) indicators may be of different colors to indicate CANDLE PRESENT (blue); PUMP ON (orange); CANDLE FULL (green) and system ERROR (red). In the preferred embodiment, fluid pumping drops off during the fill process to avoid errors. For example, AUTO (or MANUAL) filling may be very fast for first 50 ms (to overcome motor inertia); fast until 1600 ms; and slow until (1) 3750 ms or (2) candle FULL. It should be appreciated that the time intervals just provided are not the only intervals possible and may vary in accordance with candle size and other factors.

Figure 9:
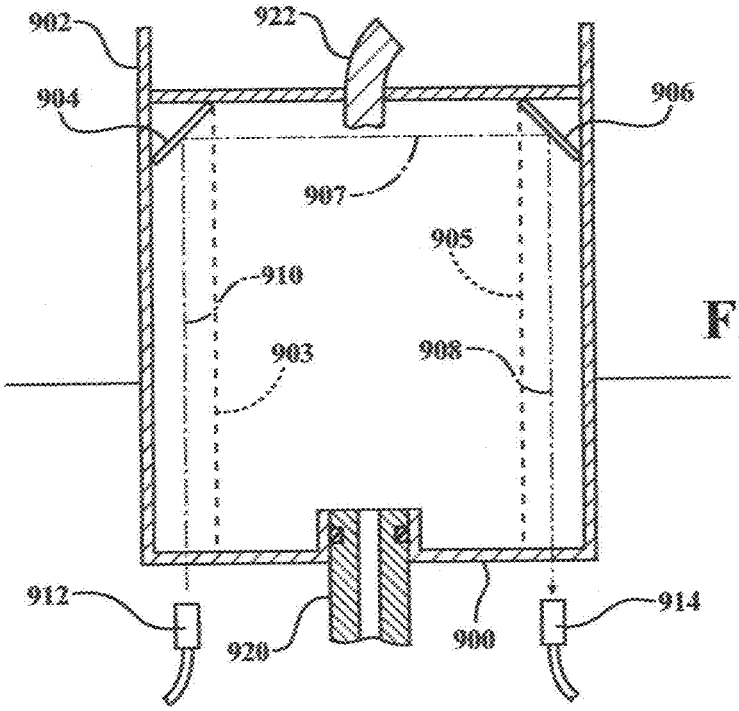
FIG. 9 depicts an alternative optical technique for detecting candle FULL status.
Figure 10:
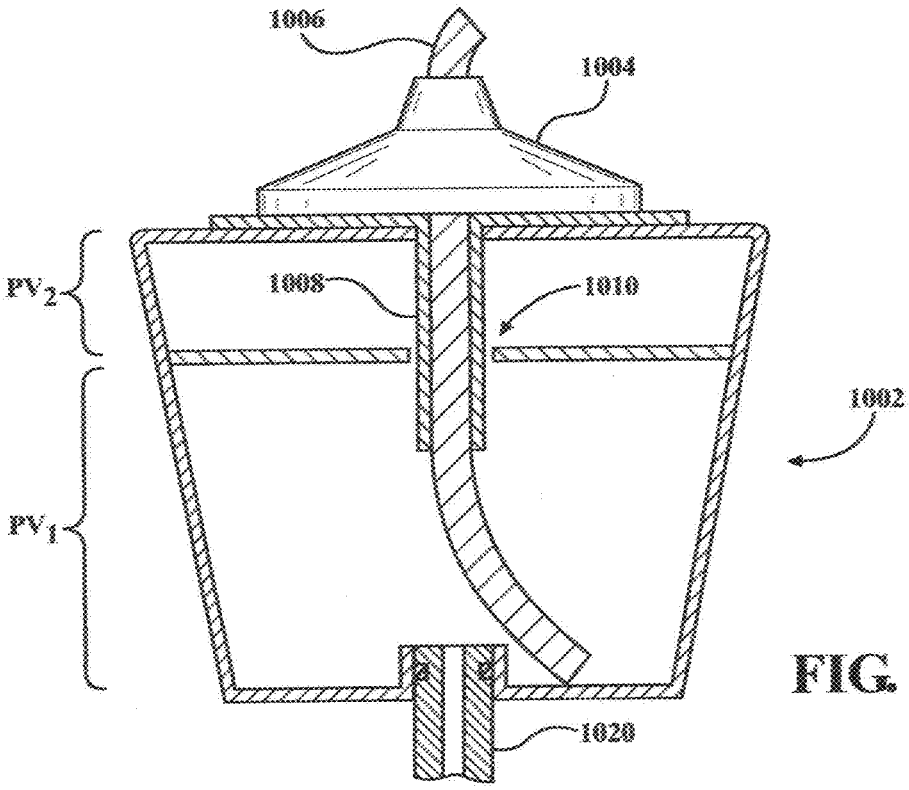
FIG. 10 describes an alternative pressure detection technique for sensing candle FULL status.

FIGS. 9, 10 depict alternative techniques for detecting candle full status. FIG. 9 uses an optical technique. In this case, assuming the bottom of the container 902 is transparent or at least translucent, when the container is properly seated over a fill tube 920, a beam of light 910 from a light emitter 912 bounces off surfaces 904, 906 and is returned as beam 908 to detector 914. The emitter 912 may be an LED, laser diode or other suitable source, and surfaces 904, 906 may be mirrored. Beams 910, 908 may simply pass through the liquid fuel or, as indicated with the broken lines 903, 905, these vertical beams may pass through a thick glass wall of the container. In any case, when the fluid reaches horizontal beam 907, the attenuation in the optical signal is detected by sensor 914, shutting off the pump. As yet a different alternative, light from a laser diode or other light source may be directed at the surface of the liquid fuel, in which case reflection of the surface may be used to detect fill level. Wick 922 is shown passing through an upper cap that may include sidewalls 902.

FIG. 10 illustrates a further option that uses pressure build-up to detect a container FULL condition. This configuration features a screw-on "replaceable wick assembly" that includes a metal cap 1004 with integrated air relief around feeder tube 1008 and an integrated wick 1006. The candle assembly 1002 has two chambers, PV1 and PV2, separated with a small opening 1010 for the feeder tube 1008 to pass through, leaving an air gap around the feeder tube. The wick assembly and body are combined by placing the wick into the opening, allowing the feeder tube to pass through the small air gap opening, thereby creating a small volume of space for air and liquid to pass.

Once candle 1002 is placed on the pumping module 1020, liquid begins to fill chamber PV1, with air escaping through the small air gap 1010 around the feeder tube. Once the liquid reaches the PV2 chamber, however, the resistance to further pumping builds rapidly, and this pressure is sensed by the pump motor controller to deactivate further pumping. This pressure build-up may be detected in various ways, including a fluid pressure sensor on the fluid inlet tube, or a rise in electrical current to the pump motor. Note that any remaining fluid that traveled up to chamber PV2 will flow back down into PV1 chamber as the candle is burned. Note that this technique may also be used in the embodiment depicted in FIG. 7A, B with or without a float sensor, as air escapes through small ports 744, 746.

The invention may be used to automatically fill any type of liquid fuel container, whether the container is used as a candle by itself, or whether the container is received by an outer holder, including more decorative glass shells with facets, lenses, etc. Moreover, the invention may also be used to refill "canned heat" or metal canisters of the type sold under the Sterno® brand name for "chafing" purposes, at least to the extent that a liquid fuel is used. As such, as used herein, including the claims, "candle" should be taken to include liquid-fuel articles used for heating as well as decorative effects.

Figure 11:
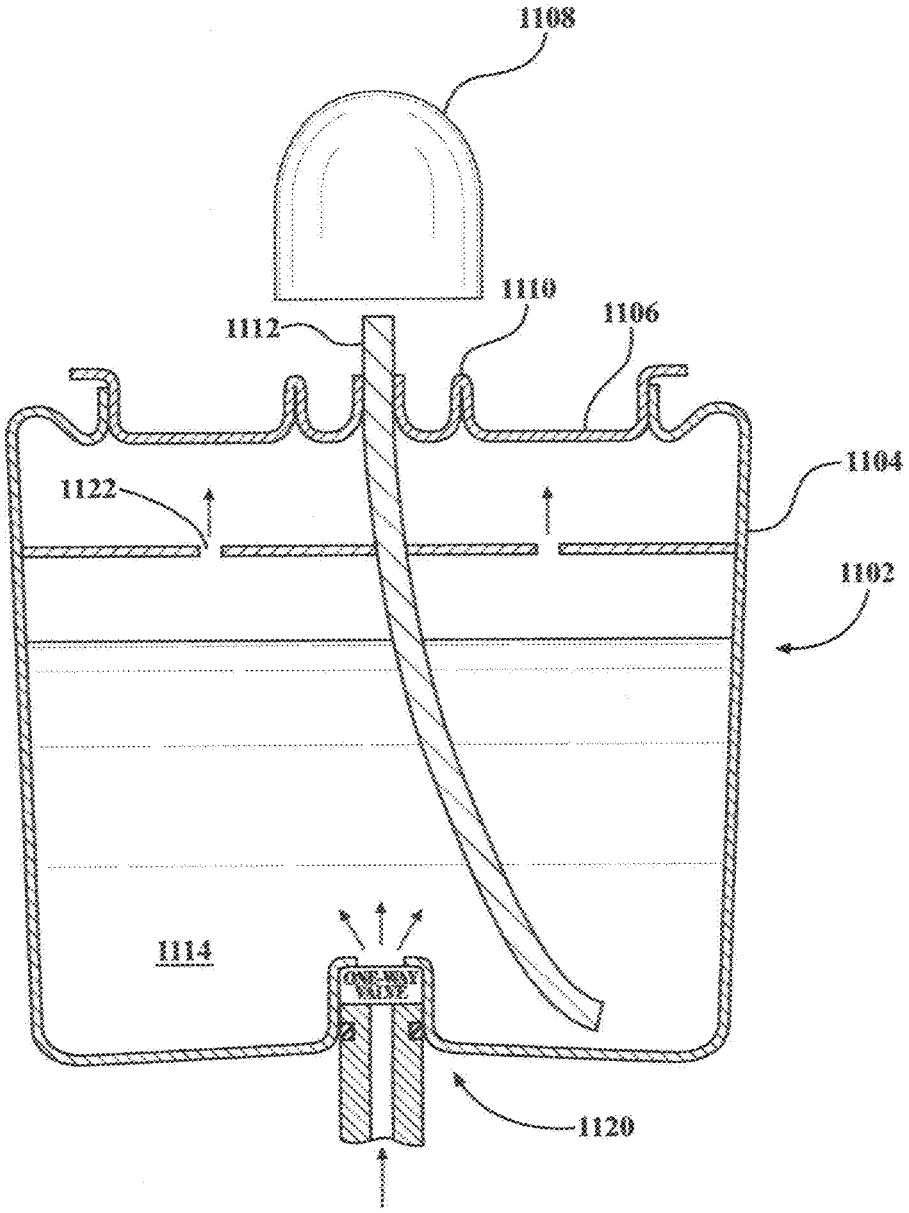
FIG. 11 shows that the invention is applicable to metal containers of the type used for chafing purposes.

FIG. 11 illustrates a bottom-refillable metal container 1102 used for chafing purposes. The container typically includes a metal housing 1104 that receives a lid 1106 including a rim 1110 that receives a cap 1108 to extinguish the flame of wick 1112. Combustible fluid 1114 is delivered through sealed port assembly 1120 and/or one-way valve 1121, with air escaping through apertures 1122. The sealed valve assembly may comprise any suitable configuration, including the valves disclosed herein. Various techniques may also be used to detect a FULL condition, including the pressure build-up mechanisms of FIGS. 7, 10.

The invention claimed is:

1. A system for refilling a liquid fuel candle, comprising:
a refillable container having an interior defined by a top, a bottom, and a sidewall;
a wick that extends from the interior of the container and protrudes through the top of the container;
a refilling station including a designated region for receiving the container;
a reservoir in the refilling station for receiving a supply of liquid fuel;
a fuel line that extends from the reservoir to the container when the container is received by the refilling station;
a pump disposed in the refilling station for pumping the fuel from the reservoir and into the container;
a user interface disposed on the refilling station including a user control operative to activate the pump, causing the flow of fuel from the reservoir and into the container; and
apparatus for sensing when the fuel delivered to the container has reached a predetermined fill level, such that when the predetermined fill level is reached, the pump is deactivated.

2. The system of claim 1, wherein the bottom of the container includes a port into which the fuels flows from the fuel line.

3. The system of claim 1, wherein the refilling station further includes an input for receiving a colorant or a scent that is added to the fuel as it flows from the reservoir to the container.

4. The system of claim 1, wherein the refilling station includes a plurality of designated regions for receiving a plurality of containers to be refilled.

5. The system of claim 1, wherein the apparatus for sensing when the fuel delivered to the container has reached a predetermined fill level includes a float switch in the container and electrical contacts between the container and the refilling station causing the pump to deactivate when the predetermined fill level reaches the float switch.

6. The system of claim 1, wherein the apparatus for sensing when the fuel delivered to the container has reached a predetermined fill level includes light source and detector in the refilling station operative to sense when the predetermined fill level has been reached.

7. The system of claim 1, wherein the apparatus for sensing when the fuel delivered to the container has reached a predetermined fill level includes apparatus for sensing the pressure required to deliver the liquid fuel to the container, such that the pump is deactivated when the pressure reaches a predetermined level.

8. The system of claim 1, wherein the top or the sidewall of the container includes a port into which the fuels flows, such that the container fills through the top or the sidewall, respectively.

9. The system of claim 1, wherein the container is a metal container and the liquid fuel is configured to provide heat through the wick when lit for chafing purposes.

10. A system for refilling a liquid fuel candle, comprising:
a reservoir containing a supply of liquid fuel;
a refilling station including a fuel line extending into the reservoir, the refilling station further including a designated region for receiving a refillable candle including a wick and a refill port;
a pump in the refilling station operative to deliver the liquid fuel from the reservoir into the refillable candle through the refill port;
a user interface disposed on the refilling station, the user interface including a user control operative to activate the pump, causing the flow of fuel from the reservoir to the candle through the fuel line; and
apparatus for sensing when the fuel delivered to the candle has reached a predetermined fill level, such that when the predetermined fill level is reached, the pump is automatically deactivated.

11. The system of claim 10, wherein the refilling station includes an upwardly oriented tube that delivers the liquid fuel to the candle through a refill port in the bottom of the candle.

12. The system of claim 10, wherein the refilling station further includes an input for receiving a colorant or a scent that is added to the fuel as it flows from the reservoir to the candle.

13. The system of claim 10, wherein the refilling station includes a plurality of designated regions for receiving a plurality of containers to be refilled.

14. The system of claim 10, wherein the apparatus for sensing when the fuel delivered to the candle has reached a predetermined fill level includes a float switch in the candle and electrical contacts between the candle and the refilling station causing the pump to deactivate when the predetermined fill level reaches the float switch.

15. The system of claim 10, wherein the apparatus for sensing when the fuel delivered to the candle has reached a predetermined fill level includes a light sensor or a fuel pressure sensor.

16. The system of claim 10, wherein the refilling station includes a processor causing the candle to be refilled in stages from a fast initial rate of refill to a slower rate of refill as the predetermined fill level is being reached.

17. The system of claim 10, wherein the user interface includes a plurality of user controls including a manual pump deactivation control.

18. The system of claim 10, wherein the user interface includes a plurality of indicator lights, at least including lights that indicate that the candle is properly seated in the refilling station and that the candle is being refilled.

19. The system of claim 10, wherein the refilling station is battery operated.

20. A refillable liquid fuel candle, comprising:
a liquid fuel container having an interior defined by a top, a bottom, and a sidewall;
a wick having a first end disposed in the liquid fuel and a second end extending through the top of the container;
a sealed refill port for receiving liquid fuel from a refilling station; and
a device on or in the container adapted to cooperate with a refilling station to determine when the liquid fuel has reached a predetermined fill level.

21. The refillable liquid fuel candle of claim 20, wherein the device on or in the container includes a float switch and electrical contacts on the container that cooperate with a refilling station.

22. The refillable liquid fuel candle of claim 20, wherein the device on or in the container includes one or more orifices facilitating the escape of air displaced during a refilling operation.

23. The refillable liquid fuel candle of claim 20, wherein the device on or in the container includes an optical path directing a beam of light to region within the container associated with a predetermined fill level.

24. The refillable liquid fuel candle of claim 20, wherein the liquid fuel is a liquefied wax or plant oil.

25. The refillable liquid fuel candle of claim 20, wherein the container is made of transparent or translucent glass or plastic.

26. The refillable liquid fuel candle of claim 20, wherein:

the container is made of metal; and further including a removable cap that fits over the wick when the candle is not in use.

27. A method of refilling a liquid fuel candle, comprising the steps of:

providing a refillable liquid fuel candle including a wick and a sealed port to receive liquid fuel;

providing a refilling station including a liquid fuel reservoir, a fuel pump, a candle docking area, and a plurality of user controls;

placing the refillable liquid fuel candle on the candle docking area of the refilling station;

activating one of the user controls, causing the fuel pump to deliver liquid fuel from the reservoir to the candle through the sealed port; and automatically terminating the flow of liquid fuel from the reservoir to the candle when a predetermined fill level has been achieved.

28. The method of claim 27, wherein the sealed port is on a bottom surface of the refillable liquid fuel candle and the refilling station includes an upwardly extending post that cooperates with the sealed port to refill the candle through the bottom of the candle.

29. The method of claim 27, wherein the refilling station includes a user interface with a plurality of refill controls and indicator light to determine refill status.

30. The method of claim 27, including the step of refilling multiple candles simultaneously.

* * * * *